US005380164A

United States Patent [19]

Fry et al.

[11] Patent Number: 5,380,164

[45] Date of Patent: Jan. 10, 1995

[54] TWO-STAGE PUMP FOR A CONTINUOUS INK JET PRINTER

[75] Inventors: Andrew R. Fry; Jeremy J. Turner, both of Royston, United Kingdom

[73] Assignee: Domino Printing Sciences PLC, United Kingdom

[21] Appl. No.: 30,329

[22] PCT Filed: Oct. 25, 1991

[86] PCT No.: PCT/GB91/01872

§ 371 Date: Mar. 16, 1993

§ 102(e) Date: Mar. 16, 1993

[87] PCT Pub. No.: WO92/08052

PCT Pub. Date: May 14, 1992

[30] Foreign Application Priority Data

Oct. 30, 1990 [GB] United Kingdom ..... 9023552

[51] Int. Cl.[6] ..... F04B 43/02

[52] U.S. Cl. ..... 417/250; 417/413.1

[58] Field of Search ..... 417/250, 244, 412, 413 R, 417/266–268

[56] References Cited

U.S. PATENT DOCUMENTS

| | | | |
|---|---|---|---|
| 3,286,933 | 11/1966 | Savage | 417/413 R |
| 3,308,765 | 3/1967 | Mutschler et al. | 417/413 R |
| 4,931,000 | 6/1990 | Fleming | 417/413 R |
| 4,990,066 | 2/1991 | Kern | 417/413 R |
| 5,219,274 | 6/1993 | Pawlowski et al. | 417/413 R |

FOREIGN PATENT DOCUMENTS

| | | | |
|---|---|---|---|
| 0042264 | 10/1983 | European Pat. Off. . | |
| 0260464 | 8/1987 | European Pat. Off. . | |
| 1188239 | 9/1959 | France . | |
| 568022 | 3/1931 | Germany | 417/413 |
| 2926362 | 1/1980 | Germany . | |
| 2934947 | 3/1980 | Germany . | |
| 2177758 | 1/1987 | United Kingdom | 417/413 |
| 385073 | 8/1973 | U.S.S.R. | 417/415 |
| 9012962 | 11/1990 | WIPO | 417/413 |
| 9119099 | 12/1991 | WIPO | 417/413 |

*Primary Examiner*—Richard A. Bertsch
*Assistant Examiner*—Peter Korytnyk
*Attorney, Agent, or Firm*—Laff, Whitesel, Conte & Saret, Ltd.

[57] ABSTRACT

A two-stage pump (9) for a continuous ink jet printing system comprises a first stage (A) which includes a chamber (91,92) having an inlet (93) and an outlet (94) via a non-return valve (115) to a channel (95). The first stage chamber (91,92) is divided by a dished diaphragm (101) movable by a first cylinder (97) mounted on a pump shaft (98). The pump (9) has a second stage (B) comprising a chamber (104,105) having an inlet (106) from the channel (95) and an outlet (107). The second stage chamber (104,105) is divided by a rolling diaphragm (116) movable by a second cylinder (108) mounted on a pump shaft (98). The cylinders (97,108) are arranged to be driven, and thus drive their respective diaphragms (101,116), 180° out of phase so that ink and air enters the first stage chamber (91,92), is pressurised by the first cylinder (97) and passed through the channel (95) to the second stage chamber, and is further pressurised and passed out of the outlet (107) of the second stage chamber (104,105).

8 Claims, 1 Drawing Sheet

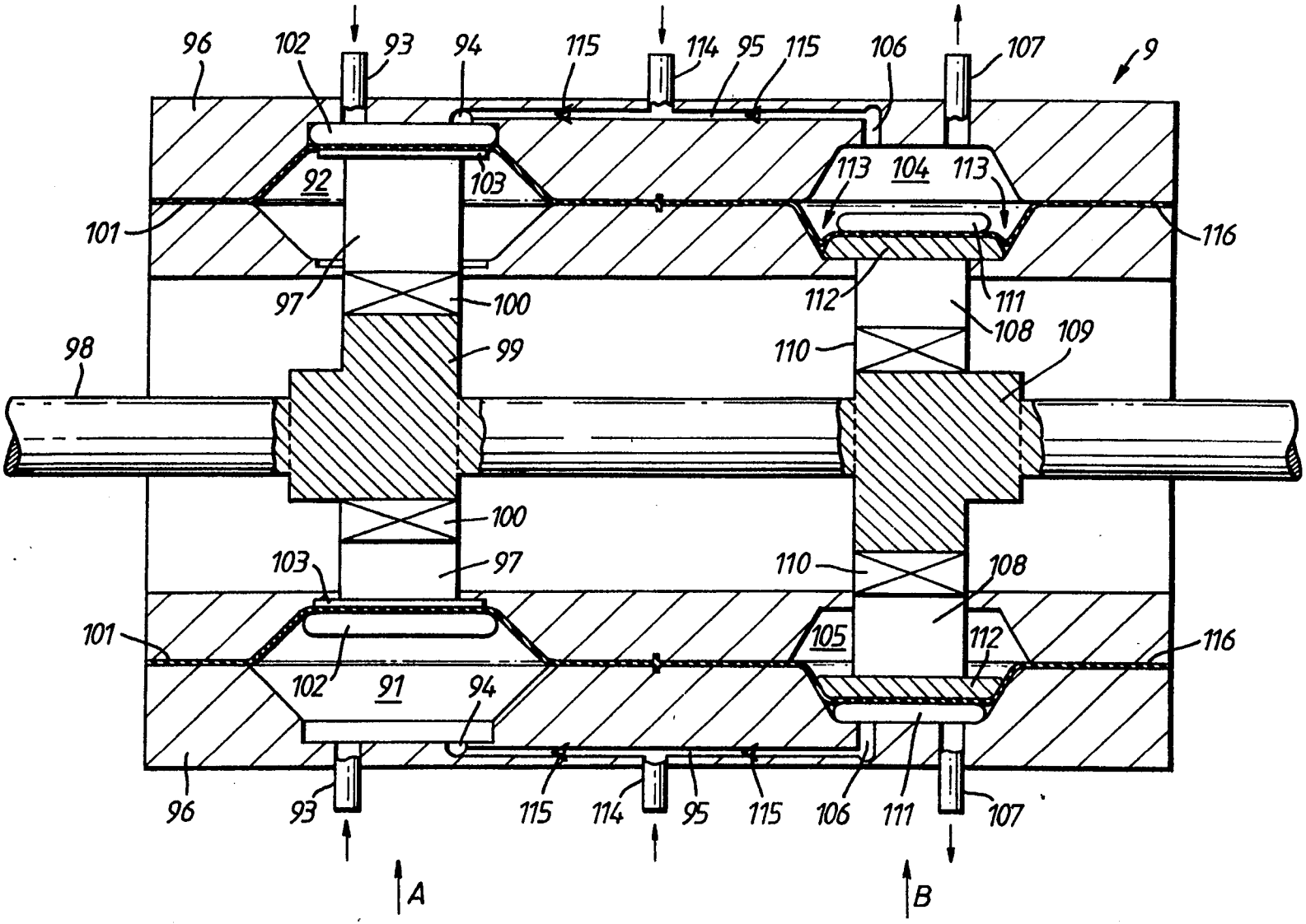
9
116
116
107
107
113
111
108
109
108
112
104
111
B
106
113
112
110
110
105
106
115
115
95
95
114
114
115
115
103
100
99
100
97
94
94
93
91
A
102
92
97
103
102
93
96
96
101
101
98

TWO-STAGE PUMP FOR A CONTINUOUS INK JET PRINTER

BACKGROUND OF THE INVENTION

The present invention relates to a two-stage pump for use in a continuous ink jet printing system.

In our copending British application number 9009957.3 there is disclosed an ink jet supply system for a continuous ink jet printer in which ink under pressure is fed through a nozzle, the ink stream being broken up into small droplets which are then individually charged and deflected in order to print on a substrate moving relative to the nozzle. The present invention relates to a pump which is suitable for use in such a system.

In a continuous ink jet printer, drops of ink are propelled at typical speeds of 18 to 25 $ms^{-1}$ over a distance of typically 75 mm. This is achieved by pressurising ink at a constant pressure within a chamber which opens into a nozzle of typical orifice size 60 $\mu$m. Pressure is applied to the ink either by direct pumping of the ink, and then regulating that pressure to the required level, or by indirect means such as pressurising the air above the ink reservoir. Unprinted ink drops are returned to the bulk of the ink via a drop catcher and gutter, through which air flows in order to move the ink along the gutter.

Known devices for applying pressure to the ink include a gear pump, in which the resulting pressure generated is usually pulsed due to the action of the gear teeth, necessitating the use of some form of damping; a compressor, in which pressure is applied to the surface of an ink reservoir, ink being transferred from a low pressure side by a separate transfer system; a peristaltic pump which is a low pressure pump frequently used for drawing ink and air down a gutter line prior to transfer to a high pressure pump; and a positive displacement pump which may operate with or without a diaphragm. When an ink jet printer is turned on, a higher flow of air is required down the gutter than is needed when unprinted drops are present in the gutter line. It is common, therefore, to design the pump to deliver a higher air flow rate than that required when the system is printing. This feature results in a high rate of ink solvent usage due to evaporation. Furthermore, it is common to direct a bleed line from the printhead to the most convenient source of low pressure, which often happens to be the gutter line, which reduces the gutter efficiency whilst the bleed is in operation. Moreover, continuous ink jet printers are often used in industrial environments, placing heavy demands on the machine, and pumps, such as gear pumps, operate at very high cycle speeds typically in excess of 1000 rpm and are thus prone to rapid wear and early failure.

SUMMARY OF THE INVENTION

According to the present invention, a two-stage pump, for use in a continuous ink jet printing system, comprises: a first stage including a chamber having an inlet and an outlet via at least one non-return valve to a channel, the first stage chamber being divided by a dished diaphragm movable by a first cylinder which is mounted on a pump shaft; a second stage comprising a chamber having an inlet from the channel and an outlet, the second stage chamber being divided by a rolling diaphragm movable by a second cylinder which is mounted on a pump shaft; the cylinders being arranged to be driven, and thus drive their respective diaphragms, 180° out of phase; whereby in use ink and air enters the first stage chamber, is pressurised by the first cylinder and passed through the channel to the second stage chamber, and is further pressurised and passed out of the outlet of the second stage chamber.

The two-stage pump of the present invention can pump ink and air from a point at typically about $4\times10^4$ Pa to a pressure of about $6\times10^5$ Pa or more, and will pump air at a sufficiently high velocity to clear the gutter of a sudden inrush of ink into an empty gutter, but, when the pump is transferring ink, the air pressure and density at the inlet decrease thereby reducing the air flow rate to that required to draw the maximum volume of ink along the gutter line from unprinted drops and maintain a steady flow of ink along the gutter.

The use of a rolling diaphragm in the second stage chamber means that the diaphragm flexes as the cylinder moves, and ink fills the fold in the diaphragm, thereby decreasing the displaced air volume, increasing the compression ratio and improving the efficiency. A simpler dished diaphragm can be used in the first stage where the relatively smaller pressure difference will not cause undue flexing of the diaphragm. High flow rate is achieved on start-up, without ink in the gutter, in order to ensure efficient clearance of the gutter on start-up, and a minimum air flow is produced during printing so as to minimise solvent consumption. This two stage flow rate can be achieved without having to alter the pump motor speed.

The channel between the two stages preferably has an inlet for a printhead bleed.

Preferably, the pump has two first stage chambers respectively connected to two second stage chambers by respective channels, each chamber having a respective diaphragm movable by a respective cylinder.

BRIEF DESCRIPTION OF THE DRAWING

The drawing is a cross-sectional view of the pump of the present invention.

DESCRIPTION OF THE PREFERRED EMBODIMENT

An example of the present invention will now be described with reference to the accompanying drawing which is a sectional view.

In the drawing, the pump 9 has two stages generally designated A and B respectively. The first stage A comprises a pair of chambers 91,92 each of which has an inlet 93 from the gutter and an outlet 94 to a channel 95 provided in each of two cylinder heads 96 of the pump 9.

A pair of cylinders 97 are mounted on a pump shaft 98 by means of an eccentric mount or cam 99 on the pump shaft 98 and suitable bearings 100. A cranked pump shaft and connecting rods may alternatively be used.

First and second pairs of diaphragms 101,116 are compressed as gaskets between each cylinder head 96 and the body of the pump 9, the gaskets 101,116 being pinched to form a seal. Each diaphragm 101,116 is preferably made of fabric-backed EPDM (ethylene-propylene-terpolymer) rubber. Each of the first diaphragms 101 passes into each chamber 91,92 of the first stage A and is clamped between two plates 102, 103 on the end of each cylinder 97. Each diaphragm 101 is "dished" i.e. it has no folds or wrinkles within the chambers 91,92.

The second stage B of the pump has a similar pair of chambers 104, 105, the channels 95 feeding through inlets 106 into a respective chamber 104, 105. Each chamber has an outlet 107, which may also be provided with non-return valves.

A cylinder 108 moves in each chamber 104, 105, each cylinder 108 being mounted on the pump shaft 98 by an eccentric mount or cam 109 and bearings 110. Again, a cranked shaft and connecting rods may be used. The second cylinder mount 109 is 180° out of phase with the first cylinder mount 99 so that the two pairs of cylinders 97, 108 move 180° out of phase.

Each of the second pair of diaphragms 116 passes into each second stage chamber 104, 105 and is clamped to a respective cylinder 108 by plates 111, 112. The diaphragm 116 in each second stage chamber 104, 105 is designed so that it "rolls" during movement of the cylinder 108 producing a fold 113 at the end of each induction stroke.

A bleed line 114 from the printhead feeds into each channel 95, each channel 95 having non-return valves 115 for preventing back flow of ink and/or air. As an alternative, the bleed line 114 could feed into the inlets 93 of the first stage chambers 91,92. The bleed line 114 may also have a non-return valve (not shown) to prevent air passing back to the printhead. The pump shaft 98 is driven by a low speed motor (not shown), which may be a stepper motor, which is set to run at a constant speed but can be speeded up, for example, on start-up. Ink and/or air from the gutter are fed to the chambers 91, 92 of the first stage A, which are capable of applying a relatively small pressure increase to the flow by movement of the cylinders 97. The first stage A is able to pump air containing about 5% by volume of ink from a partial vacuum to a pressure slightly above atmospheric pressure, the volumetric displacement of the chambers 91,92 being sufficient to produce an air flow along the gutter when free of ink of about five times that when ink is present.

Ink and air are forced through the channels 95 to the second, high pressure stage B. In the chambers 104,105 of the second stage B, as the cylinders 108 move, the diaphragms 116 flex, and ink fills the recesses in the diaphragms 116, this ink not being completely expelled with each stroke. This decreases the displaced air volume, giving a high compression ratio which allows for high efficiency and the raising of the pressure of the ink and/or air from approximately $1.5\times10^5$ Pa to approximately $5\times10^5$ Pa. Ink and air under high pressure pass out of the outlet 107.

As the cylinders operate 180° out of phase, there will a tendency for the output pressures and suction generated by the pump to pulsate. This could cause problems, particularly with gutter suction which could give rise to variable performance. To reduce this effect to an acceptable level, the inlets 93 to the chambers 91,92 of the first stage A should be wide bore tubes of capacity approximating to that of the gutter line to form an effective plenum to smooth pressure pulsations.

The pump described has a minimum of moving parts, all of which are subjected to relatively low stress when run at the typical operating speed of 20 rpm. The air drawn by the pump is at all times kept to a minimum so as to reduce the loss of solvent by evaporation and the pump also provides a point for receiving the bleed from the printhead.

In a particular embodiment, with no printing and no ink jet running, the air flow was about 500 ml/min. With the ink jet on, the choking of the gutter line by the ink lowers the pressure at the inlet to the first stage and the air flow fell to about 120 ml/min, with an additional 7 ml/min of ink.

When the ink jet is turned off, the ink in the folds of the rolling diaphragms 116 is gradually displaced, and the air flow through the pump and the inlet pressure to the first stage increase.

We claim:

1. A two-stage two-phase pump, for use in a continuous ink jet printing system, comprising a first stage including a chamber having an inlet and an outlet via at least one non-return valve to a channel, the first stage chamber being divided by a dished diaphragm fixed to and movable by a first cylinder which is mounted on a pump shaft; a second stage comprising a chamber having an inlet from the channel and an outlet, the second stage chamber being divided by a rolling diaphragm fixed to and movable by a second cylinder which is mounted on a pump shaft wherein the channel between the two stages has an inlet for a bleed from a printhead; the cylinders being arranged to be driven, and thus drive their respective diaphragms, 180° out of phase; whereby in use ink and air enters the first stage chamber, is pressurized by the first cylinder and passed through the channel to the second stage chamber, and is further pressurized and passed out of the outlet of the second stage chamber.

2. A pump according to claim 1, having two first stage chambers respectively connected to two second stage chambers by respective channels, each chamber having a respective diaphragm movable by a respective cylinder.

3. A pump according to claim 2, wherein each cylinder is mounted on its respective pump shaft by means of an eccentric cam.

4. The pump according to claim 3 wherein the first stage is constructed to pump air containing about 5% by volume of ink from a partial vacuum to a pressure slightly above atmospheric pressure.

5. The pump according to claim 2 wherein the first stage is constructed to pump air containing about 5% by volume of ink from a partial vacuum to a pressure slightly above atmospheric pressure.

6. A pump according to claim 1 wherein each cylinder is mounted on its respective pump shaft by means of an eccentric cam.

7. The pump according to claim 6 wherein the first stage is constructed to pump air containing about 5% by volume of ink from a partial vacuum to a pressure slightly above atmospheric pressure.

8. The pump according to claim 1 wherein the first stage is constructed to pump air containing about 5% by volume of ink from a partial vacuum to a pressure slightly above atmospheric pressure.

* * * * *